United States Patent [19]

Lane, Jr.

[11] Patent Number: 4,496,070

[45] Date of Patent: Jan. 29, 1985

[54] CONTAINER AND LID FORMING A DISPOSABLE MOLD

[76] Inventor: Samuel H. Lane, Jr., 1807 Cedar Elm Dr. W., Arlington, Tex. 76012

[21] Appl. No.: 583,760

[22] Filed: Feb. 27, 1984

Related U.S. Application Data

[63] Continuation-in-part of Ser. No. 428,153, Sep. 29, 1982, abandoned.

[51] Int. Cl.[3] ..... B65D 41/16; B65D 41/18

[52] U.S. Cl. ..... 220/306; 206/605; 249/164

[58] Field of Search ..... 220/306; 249/61, 115, 249/112, 134, 164, DIG. 4; 206/605, 612

[56] References Cited

U.S. PATENT DOCUMENTS

| | | | |
|---|---|---|---|
| 3,163,908 | 1/1965 | Lawmaster | 249/164 |
| 3,527,164 | 9/1970 | Lawmaster | 249/164 |
| 3,759,415 | 9/1973 | Cloyd | 220/306 |
| 4,004,710 | 1/1977 | Crisci | 220/306 |

*Primary Examiner*—George T. Hall

*Attorney, Agent, or Firm*—Wofford, Fails & Zobal

[57] ABSTRACT

A combination employing a disposable mold for making a test sample of set concrete or the like comprising a unitary plastic piece that includes a closed bottom end, a cylindrical, tubular wall extending substantially perpendicular to the bottom end and connected therewith and terminating in an open end and an annular lip connected with the cylindrical, tubular wall adjacent the open end; a locking, moisture-proof lid adapted to snap into place; and a carrying tong adapted to removably slide into engagement with said annular lip so as to carry said mold and any material in sample therewithin. Also disclosed are method of obtaining the concrete sample and the capping composition, each of which use the disposable mold. Preferably, the mold has a removable strip such as a scored stripping line or a tear away strip to facilitate removal from about the test sample. Precautions are taken to ensure that all diameters are within the tolerances allowed by the American Society For Testing Materials (ASTM) Specification C-470. Preferably, the tubular, cylindrical wall has a textured surface on its outside for receiving a written legend, such as identification of the core sample.

11 Claims, 8 Drawing Figures

FIG. 4
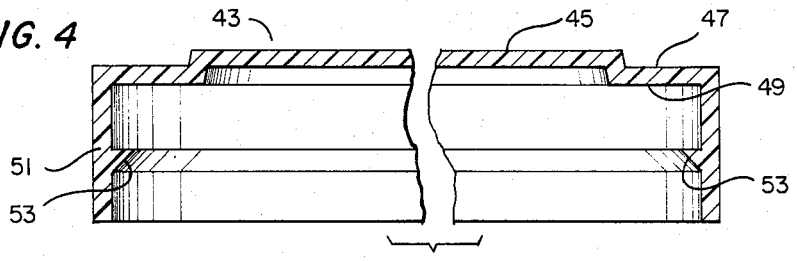
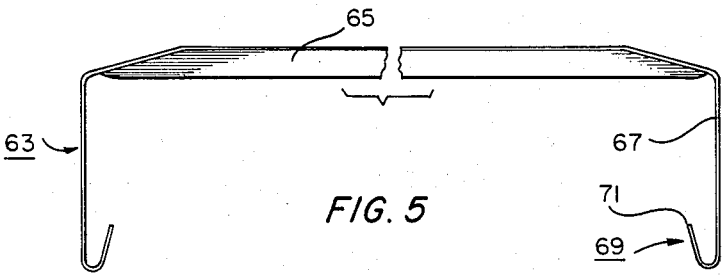
FIG. 5
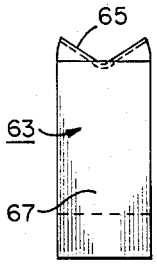
FIG. 6
FIG. 7
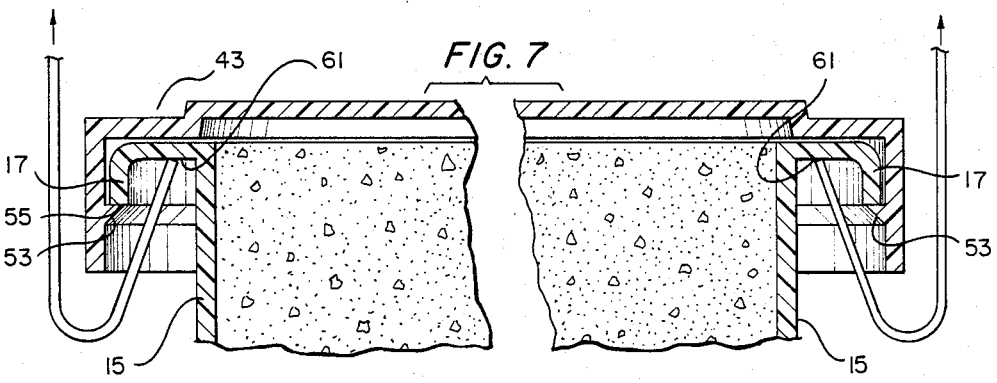
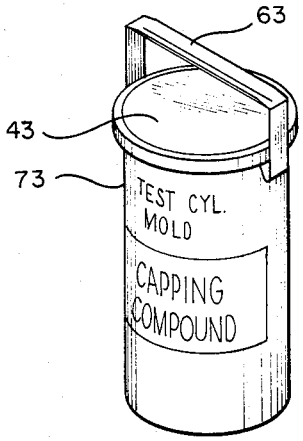
FIG. 8

CONTAINER AND LID FORMING A DISPOSABLE MOLD

CROSS REFERENCE TO RELATED APPLICATION(S)

This application is a continuation-in-part of Ser. No. 428,153, filed 09/29/82, now abandoned.

FIELD OF THE INVENTION

This invention relates to combinations, methods and capping compounds for casting test samples of concrete for destructive testing. More particularly, it relates, respectively, to a combination, a method and a capping compound with disposable molds for casting test samples of concrete, gypsum and like materials.

DESCRIPTION OF THE PRIOR ART

The quality and strength of certain materials such as concrete mixes are tested by casting test samples, such as cylinders and subjecting the test samples to various tests, including the test of ultimate strength in which the cylinders are tested to destruction. The test samples are cast in various stages of formulation or use of the material to be tested. For example, in concrete, the tests may be conducted at any time to ascertain the quality of particular mixes of cement, sand and aggregate. These tests are helpful in maintaining the quality of the concrete mixes during progressive stages of construction; particularly in the pouring of foundations or other large concrete structures such as dams.

The most widely used molds for casting such cylindrical test samples have been on non-reusable materials such as paperboard. Paperboard molds are easily damaged such that they cannot be used, and when damaged in shipment or storage, do not have the resiliency to spring back into conformity to be within specifications of the American Society for Testing Materials (ASTM). Also, vertically split sectional molds that have been emplaceable within a unitary structure have been known in the prior art. These molds have required a person to bend or squat, and tilt the mold to pick up the sample and have allowed carrying only one.

Typical of the wide variety of types of molds that have been employed in the prior art heretofore are the following patents. U.S. Pat. No. 195,062 shows a paper vessel for molding pitch with an open sheet metal ring forming the continuous wall. U.S. Pat. No. 811,310 shows a mold having a plurality of pieces that are fastened together by over-the-center couplings with a core and a jacket, or shell, surrounding the core. U.S. Pat. No. 1,171,641 shows a contracting core for cement lined pipe so that the core can be removed from the pipe and serve as an internal mold. U.S. Pat. No. 1,470,008 shows a barrel-like structure for molding asphalt. U.S. Pat. No. 1,591,060 shows a form for casting plastic materials having a collapsible core. U.S. Pat. No. 1,656,886 shows a mold for molding artifical stone. U.S. Pat. No. 2,644,220 shows a method of producing test specimens of concrete for pressure tests having a bucket-like mold with a peripheral bail and a cover that can be clasped into position, as by a screw. U.S. Pat. No. 2,799,073 shows a disposable mold for forming building stones from porous concrete. The mold is large and bulky. U.S. Pat. No. 2,870,515 shows a mold assembly for manufacturing concrete inlet tops for storm drains. U.S. Pat. No. 3,021,695 shows high density polyethylene ice mold for making ice and the like. U.S. Pat. No. 3,163,908 shows a mold for casting test samples having a plurality of pieces that are reusable. U.S. Pat. No. 3,461,192 shows apparatus and method for obtaining test cores, either cylindrical, pyramidal and the like within an outer large block from which the sample is later extracted after curing in place. U.S. Pat. No. 3,589,665 shows a similar device for obtaining concrete test specimens having the same curing environment as the structural element, similarly as the preceding patent.

Also, typical foreign patents are: French No. 891.627 showing a mold that can be wrapped around a sample; British No. 974,099 showing a multiple piece mold that can be bolted around the sample; and German No. 869,021 showing a mold for molding concrete sample as in a trapezoidal cross sectional shape or the like.

In addition, in the parent application there was cited the following United States patents. U.S. Pat. No. 2,259,854, Langel, discloses a ring mold having separable meeting ends with a clip separable from the mold for preventing leakage at joints. This reference does not seem appropriate or pertinent. U.S. Pat. No. 3,176,503, DiStasio, discloses a method for obtaining test scores in which the sample full of wet concrete is inserted within an annular skirt and allowed to cure in situ, or at the test site, so as to be absolutely representative. This is a very expensive approach, both in terms of the in situ curing and then cutting out the sample and having to repair the hole left. Moreover, it is not really pertinent to applicant's combination, method or composition. U.S. Pat. No. 3,442,481, DiStasio, shows a curing mold where the curing is done in the same environment as the concrete to give an absolute test. Again this is prohibitively expensive in terms of in situ curing, cutting out and repairing. Moreover, it is not really pertinent to applicant's combination, method or capping composition. U.S. Pat. No. 3,490,577, Grikscheit, has a flexible inner wall with a hardened outer wall that would not produce a core sample that would meet ASTM C-470. For example, it would allow the concrete to form impermissible bulges when it is appropriately tamped as described in the ASTM Specification C-470. Also, it would allow the sample to lose intolerable amounts of moisture from the concrete because of the wicking out; that is, weeping; of the moisture from the concrete sample. In that patentee's own reference, the patentee notes that the stripping line is only in the outer, densified polyurethane and that obtaining the sample requires stripping and chipping away the open cell polyurethane from the test sample. U.S. Pat. No. 3,527,439, Lawmaster, describes a multiple part mold that is reusable and has split skirt for inserting within an outer mold. The pre-formed, co-engaging parts is an expensive way to do the same job as is done in applicant's invention. Because of the expense, these prior art molds are no longer in production. Moreover, they are not really pertinent to applicant's combination, method and composition.

None of these prior art references, however, show a simple, inexpensive, disposable mold that can be employed to mold a cylindrical test specimen that will meet the ASTM Specification; that will allow carrying the test sample without tilting it and without unduly burdening the person by having to carry single test samples which ordinarily weigh in the range of 30–50 pounds; that will allow multiple samples to be carried by way of carrying tongs without distorting the test sample; that can facilitate stripping away of the mold and applying capping composition to the test sample so that it is ready for testing in a short time; and that will still obviate the disadvantages of the prior art.

SUMMARY OF THE INVENTION

Accordingly, it is an object of this invention to provide a simple, inexpensive mold that can be employed to mold a cylindrical specimen that will meet the specifications of ASTM; that will allow the carrying of multiple samples by a worker by way of carrying tongs; and that will otherwise obviate the disadvantages of the prior art.

It is a specific object of this invention to provide a disposable mold that is economical, readily useful in making a test sample; that is easily removed from the test sample and discarded without altering the test specimen beyond the specification allowed by ASTM; that can be readily carried by carrying tongs in one hand and that has numerous lesser advantages like being able to use the carrying tong to smooth off the top of the cylinder, clip on the carrying tong and easily remove it; provide a locking moisture-proof lid; and that provides reinforcing and carrying capability without having to tilt the container and get down on the knees to pick up the container and sample.

These and other objects will become apparent from the descriptive matter hereinafter, particularly when taken into conjunction with the appended drawings.

In accordance with one embodiment of this invention there is provided a combination container and mold comprising a container bucket portion; a locking, moisture-proof lid; and a carrying tong. The container bucket portion includes a closed end bottom; a cylindrical, tubular wall extending perpendicular to the bottom, connected therewith and terminating in an open end; the cylindrical, tubular wall being so nearly cylindrical that all diameters thereof are within the Δd specifications allowed by ASTM C-470; an annular lip being connected to the cylindrical, tubular wall adjacent the open end to reinforce the open end and keep it within the Δd allowed by ASTM C-470 for being circular; and removing means for facilitating removal of the mold from around the test sample once the sample has set up the desired time interval. The removing means are disposed longitudinally of the cylindrical, tubular wall and are adapted to facilitate rending the wall for removal of the mold.

The mold preferably has a textured surface on its exterior for receiving a written legend such as identification of the test sample.

The lid consists essentially of a circular portion having a substantially flat top for extending across the bucket portion and having a downwardly depending skirt at its periphery for grippingly encompassing the outside periphery of the lip on the bucket. The skirt includes a tapered shoulder means disposed interiorly annularly therearound for being slid downwardly over the lip and snapping into conforming engagement with the underside of the lip.

The carrying tong has a handle at least as long as the diameter of the bucket portion, has downwardly depending bail sections at each end of the handle and connected therewith and has a carrying means at the bottom end of the bail sections for picking up and carrying the container bucket portion, lid and any sample or material contained therewithin. Specific preferred embodiments of the combination container and mold are specifically described in more detail later hereinafter.

In another embodiment of this invention, there is provided a method of sampling concrete to ensure that it meets ASTM Specification C-470 comprising the steps of:

a. obtaining a cylindrical bucket portion full of wet concrete, the cylindrical bucket portion having the characteristics delineated in the preceding paragraph;
b. leveling off the sample at the top of the bucket portion;
c. emplacing a lid over the sample and bucket portion with an interior shoulder engaging the lip to ensure roundness and trap in moisture;
d. allowing to stand for a minimum ΔT1;
e. picking up bucket portion lid and sample with a carrying tong without tipping the sample and without requiring getting down on one knee and picking up the 30–50 pound sample and carrying it to a curing place;

(at this point it is usually advantageous to remove the container to allow the concrete sample to cure in the damp atmosphere of a curing vault or the like)

f. letting the sample cure for the desired interval ΔT2;
g. capping the cured sample with molten slurry capping compound;
h. letting the sample with the caps in place cure for sufficient time to reach compressive strength for the capping compound, the time being referred to as ΔT3;
i. testing the sample destructively.

Preferably, the capping compound is shipped as dry ingredients in a combination mold and container such as described in the preceding paragraphs such that when the capping compound is poured out for use, a useable mold is provided.

In still another embodiment of this invention there is provided a capping composition for capping a test sample of concrete before it is destructively tested, the capping composition comprising the following proportions of the following ingredients:

51–58 percent by weight sulfur
16–20 percent by weight silica sand (in particulate form)
14–18 percent by weight clay
3–5 percent by weight silica flour.

The composition is supplied in dry form and is adapted for being reduced to a molten slurry that can be applied to the top and bottom of the test sample and will cure to a compressive strength greater than 6,000 pounds per square inch in a couple of hours.

Also disclosed is a preferred composition comprising about 58 percent sulfur, 20 percent silica sand, 18 percent clay and 4 percent silica flour. When the term "percent" is employed herewithin, it is employed in the sense of percent by weight of a composition unless otherwise specified.

BRIEF DESCRIPTION OF THE DRAWINGS

FIG. 4 is a partial cross-sectional view, partly cut away, of a lid in accordance with a combination embodiment of this invention.

FIG. 5 is a side elevational view, partly cut away, of the carrying tong of the combination of one embodiment of this invention, as in FIG. 4.

FIG. 6 is an end view of the carrying tong of FIG. 5.

FIG. 7 is a partial cross-sectional view, partly cut away, showing respective co-operating portions of a container bucket co-engaging lid and carrying tong; with a test sample within the bucket portion for being carried to a curing place.

FIG. 8 is a side elevational view of a container of capping compound with the carrying tongs in place in accordance with one embodiment of this invention.

DESCRIPTION OF PREFERRED EMBODIMENT(S)

One of the advantages of this invention is the wide flexibility in terms of the combination container and mold, method and capping compound composition that can be employed in a variety of ways.

In particular, it should be borne in mind that the disposable combination container and mold may be employed for making any sample or the like for testing a particular material. It is particularly useful and is designed, however, for forming test cylinders of concrete, gypsum or similar materials. Consequently, it is in this environment that it will be described hereinafter.

As is recognized, this environment has certain prescribed tolerances that are allowable by the association responsible for obtaining uniform results. This is ordinarily the American Society For Testing Materials and is referred to generally as ASTM.

The particular specification controlling the composite test is ASTM C-39, "Standard Test Method For Compressive Strength Of Cylindrical Concrete Specimen". The specification for the mold is ASTM C-470, "Standard Specification For Mold For Forming A Concrete Test Cylinders Vertically". The specification for capping compound is ASTM C-617. These are well known and need not be described in detail herein, since they do not involve new matter, but are part of the well established technical literature.

As used herein, the term "cylindrical" is employed in its gross engineering sense of being substantially cylindrical or cylindrical with the prescribed tolerances. Expressed otherwise, the diameters as measured through the center of the mold at any point along the cylindrical mold on a perpendicular axis with respect to the central longitudinal axis of the mold do not depart from the prescribed dimensions of the mold; for example six (6) inches; by more than the Δd allowed by ASTM. Similarly, the term "planar" is employed to mean substantially planar.

Figure 1:
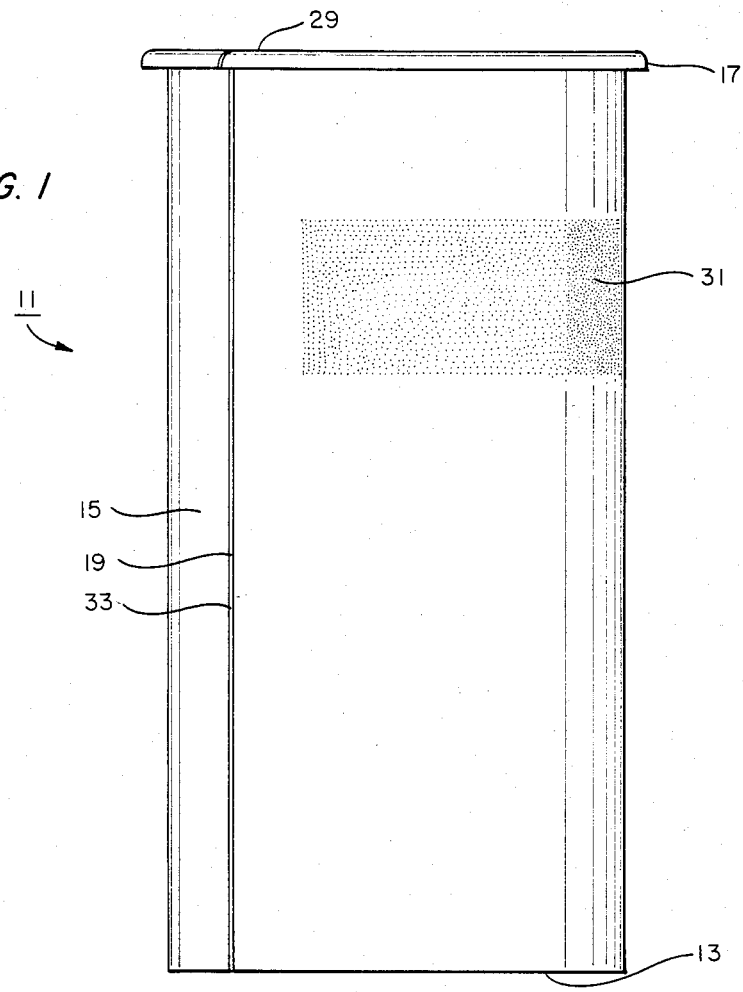
FIG. 1 is an isometric view of a container bucket portion of this invention.
Figure 2:
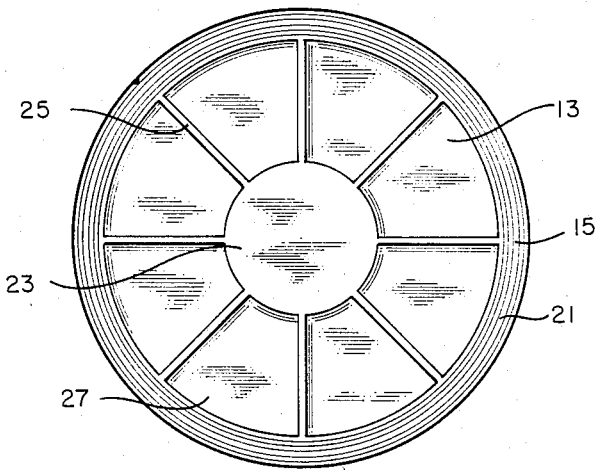
FIG. 2 is the bottom view of the container bucket portion of FIG. 1.

It is believed helpful in considering the embodiment of this invention to look first at the heart of the combination, commonly referred to as the mold, or bucket portion, of the combination. Referring to FIG. 1, the mold 11 comprises a closed bottom end 13, FIGS. 1 and 2, a cylindrical tubular wall 15, an annular lip 17, FIG. 1, and a removing means 19 for facilitating removal of the cylinder from a set test specimen.

The mold is preferably formed of a unitary plastic piece that can be prefabricated in one unit molding operation rather than have to adhere the bottom to the wall or the like.

The bottom end 13 may comprise a flat planar end that is easily molded if desired. Frequently it is advantageous, however, to employ a thicker bottom with supporting rings 21 around the outside periphery and a solid flat center support 23, FIG. 2. Ribs 25 complete support of the planar interior surface shown by the panel 27. In this way, a flat end results on the test specimen, yet the bottom 13 resists a distortion response to uneven surfaces in the event that the wet concrete interiorly of the mold is set on such uneven surfaces. On course, any other bottom end could be employed if desired.

The tubular cylindrical wall 15 is substantially uniform in thickness throughout its peripheral extent. While the wall 15 can be adhered to the bottom 13 if desired, it is preferably molded in a unitary piece. The tubular cylindrical wall has a uniform thickness. While any thickness can be employed that will still be economical and result in the desired interior dimensions, it has been found preferable to employ a thickness within the range of 0.05 inch to 0.125 inch. For example, with a six (6) inch diameter cylinder about 12 inches long, a thickness of 0.070 inch has been found to perform satisfactorily. The thicknesses may be greater or lesser as larger or smaller sizes are needed for different sized samples, or test specimens.

The tubular wall is cylindrical and terminates in an open end.

Figure 3:
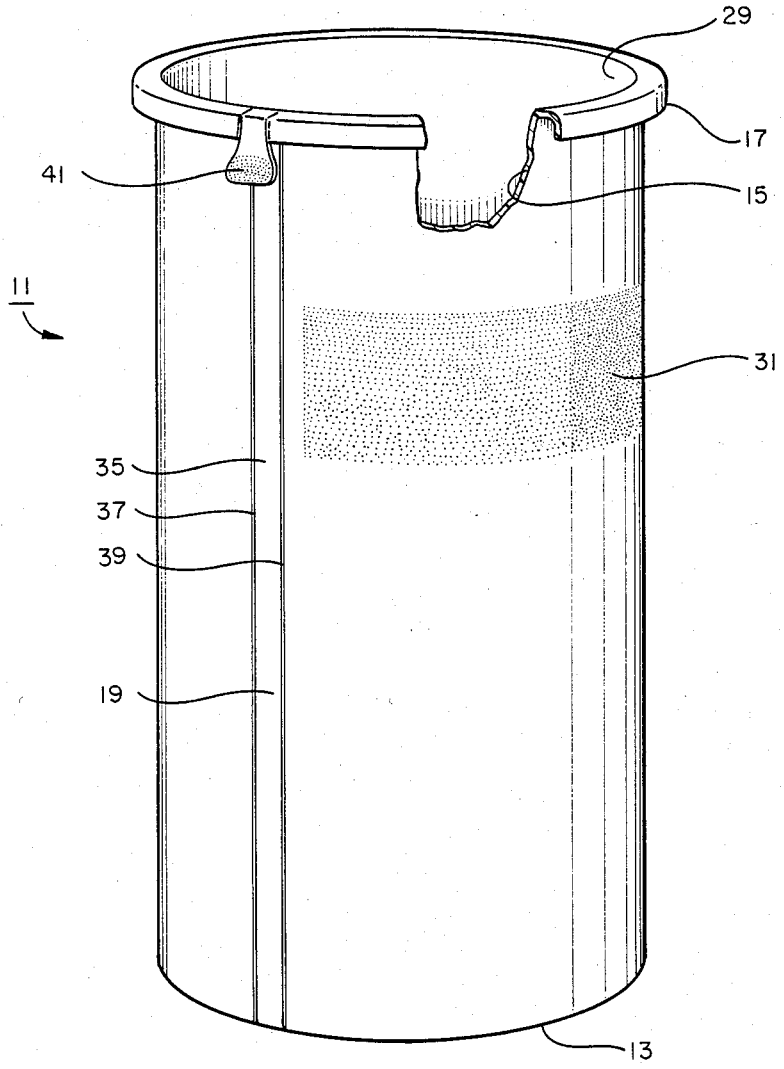
FIG. 3 is an isometric view of another embodiment of a container bucket portion in accordance with this invention.

An annular lip 17 is connected to the cylindrical tubular wall at the open end to reinforce the open end 29 and keep the open end within the Δd inch of being circular so as to be within ASTM specifications. The annular lip may comprise any size desired. For example, the thickness of the lip may be in the range of one-eighth ($\frac{1}{8}$) inch to three-eighths ($\frac{3}{8}$) inch. A typical satisfactory annular lip has been found to comprise the same wall thickness turned at a radius of about one-eighth ($\frac{1}{8}$) inch but having an outside diameter that is greater than its inside diameter by a dimension within the range of 0.25–0.75 inch. For example, about 0.628 inch has been found satisfactory with the six (6) inch test specimen mold described hereinbefore. Preferably the open end 29 is substantially planar such that excess sample material can be wiped from its top by passing a straight edge along the boundary, such as the lip 17. In this way a substantially planar end is formed on the test sample. Typical structure for the ring 17 can be seen in FIG. 3 where it is partially broken away.

The mold 11 has a textured surface 31 adapted for receiving a written legend or the like. For example, the identification of the particular batch of concrete or the like from which the test sample was taken may be written in on the textured surface 31 for identity and make unnecessary the attaching of tags or the like otherwise identifying the sample.

The removing means 19 may comprise any of the approaches to removing the mold 11 from the set test specimen. For example, as illustrated in FIG. 1, the removing means 19 comprises a scored line 33 that does not introduce anomalies into the test specimen but which can have a tool, hook or the like pulled down and tear along it to facilitate removal of the disposable mold from about the set test sample. If desired, on the other hand, the removing means 19 may comprise a strip 35 defined between a pair of scored lines 37, 39. In this way, the tab 41 can be pulled to pull the strip from the wall 15 and leave a discontinuous wall that can easily be removed from the test sample. This prevents having to go to the critical degree of taper of prior art to have a frusto-conical section that still did not depart from the ASTM specifications.

The unitary, disposable mold can be formed of any material having the requisite lightweight, structural strength and resistance to warping. For example, it could be formed of metal or even paper or a combination thereof as has been done in the prior art. Preferably, however, it is formed of a thermosetting or thermoplastic plastic. In the preferred embodiment it is formed of acrylonitrile butadiene styrene copolymer, polypropylene, polyvinylchloride or even polyethylene if suitably treated and densified.

A locking, moisture-proof lid 43 is illustrated in FIG. 4. The lid is substantially circular and has a circular portion 45 that is substantially flat and affords the top. An annular indentation 47 is disposed at its periphery to allow the interiorly protuding ring 49 which is coextensive in radial dimension with the lip 17. The lid 43 has a downwardly depending skirt 51 about its periphery for grippingly encompassing the outside periphery of the lip on the bucket. The skirt includes a tapered shoulder means 53 for being slid downwardly over the lip and slipping into conforming engagement with the underside lip, as illustrated in FIG. 7. The underside 55 of the lip 17 is also illustrated in FIG. 7. The lip 17 also preferably has a substantially planar annular portion 61 for receiving the flap end of a carrying tong as will become apparent from descriptive matter later hereinafter.

The lid may be formed of any material. Preferably it is formed of a flexible plastic similarly as is the bucket portion, or mold 11. Specifically delineated are the preferred types of thermoplastics including but not limited to acrylonitrile butadiene styrene copolymer, polypropylene, polyvinylchloride or even polyethylene, suitable treated and densified.

A typical carrying tong 63 is illustrated in FIGS. 5 and 6. The carrying tong has a handle 65, FIG. 5, that is at least as long as the diameter of the bucket in order that downwardly depending bail sections 67 can be substantially vertical, or perpendicular thereto. The bail sections 67 are disposed at each end of the handle 65 and connected therewith. At the bottom end of the respective bail sections are disposed respective carrying means 69 for picking up and carrying a combination container mold, lid and any sample or material contained therewithin. This facilitates carrying with one hand such that a plurality of the molds and samples can be carried by a workman in contrast with the prior art.

Specifically, the carrying means 69 comprises an arcuately inwardly and upwardly bent end 71 that is substantially planar and flat for engaging the annular portion 61 of the lip 17 for carrying without disrupting the lid when it is in place. Expressed otherwise, the end 71 is bent to protrude interiorly and upwardly with respect to the downwardly extending bail section 67 for engaging the annular portion 61 of the lip 17 without disrupting the conforming encompassing of the lid 43. It is noteworthy that the use of the indentation 47 allows substantially the same thickness in the lid even with the ring 49 being molded thereon. As can been seen in FIG. 6, each downwardly depending bail section 67 is substantially as wide as the handle 65 for strength in carrying and for preventing puncturing the planar portion of the lip on the mold, or bucket portion, 11.

The carrying tongs are preferably formed of metal, since it can be easily bent into shape and is resistant to cold flow, has greater structural strength and is otherwise advantageous compared to plastic or the like.

It has been found advantageous to employ black plastic for the bucket portion, for the lid and to paint the metallic carrying tongs black.

In the prior art, it has been found preferable to employ lubricant on the surface of molds. Lubricant can be employed with this mold to facilitate removal of a secured sample although it is no longer necessary because removing means 19 facilitates removal of the mold from about the cured sample in this invention.

The method of this invention will become even clearer than already delineated in the summary of the invention when the operational section is discussed later hereinafter.

The capping composition of this invention is simply a composition that has critical proportions of particular ingredients that allow it to be reduced to a molten slurry that can be applied to the top and bottom of a test sample and that will cure in only a couple of hours to have a compressive strength greater than 6,000 pounds per square inch, greater than required by ASTM Specification C-470 and related specifications that are cited therein. Specifically, the capping composition has the following proportions of the following ingredients: 51–58 percent by weight sulfur; 16–20 percent by weight silica sand in particulate form; 14–18 percent by weight clay; 3–5 percent by weight silica flour.

The sulfur is in the amorphous form initially although when it is melted by being taken to a temperature of about 275° F. it will form rhombic form which has greater strength and serves to bind the other ingredients together.

The silica sand is in particulate form that will pass through a 100 mesh screen U.S. standard sieve size so as to prevent particles that are too large; yet no finer than passing 200 mesh or it will settle out.

The clay, similarly is in particulate form so as to pass through a 100 mesh screen and be retained on a 200 mesh screen, as described with respect to the sand. This prevents large agglomerations of clay that would not work to form a high compressive strength cap on the end of the test samples.

The silica flour must pass 170 mesh screen and be retained on a 230 mesh screen in order to keep the 20 percent sand from settling in the dry mixture.

While the foregoing concentration range of the respective ingredients are the outside ranges of the proportions that form the advantageous capping composition, the preferred and optimum admixture appears to be about 58 percent sulfur, 20 percent silica sand, 18 percent clay and 4 percent silica flour.

By using this invention, the capping compound can set to a strength of about 8,000 pounds per square inch (psi) in only a couple of hours, whereas the best the prior art could afford was to set to about 5,000–6,000 pounds per square inch.

Preferably in this invention the capping compound is shipped in a test mold 73, FIG. 8, that can be readily carried by the carrying tong 63 with the lid 43 in place. When it is ready to use the capping compound, it is poured from the container 73 and heated up to the melting temperature. It is recognized that most of the ingredients do not melt but that it is the sulfur that melts to form the so-called molten slurry.

In operation, many of the same steps that have been employed in the past will be employed herein. Specifically, the test molds are molded in place and shipped in suitable containers with or without molding compound therewithin. The lids and carrying tongs may be supplied separately. At the warehouse or the like for the engineering firm, or whoever does the testing, the container is opened and the respective disposable molds are taken to sample the concrete or the like. The test concrete is then poured into the respective molds and the excess material wiped from the top of the open mold by moving a straight-edge, such as the carrying tong, along the lip 17. The mold containing the test sample then has the cap placed thereon. The cap locks in place and is moisture proof. The container then will weigh about 37 pounds. In the past, it has been necessary to squat down and lift the mold, one mold per workman, and carry each alone to the truck or the like. With this invention, at least two samples can be carried by a work person with the carrying tongs. The mold containing a test sample is then taken to a suitable storage area for curing. Ordinarily the storage area is a cool, damp vault where the test sample is allowed to cure for the predetermined period; for example, one (1), seven (7), fourteen (14), or twenty-eight (28) days. The test sample may be removed from the mold before curing and, at least before capping, by either insertion of a screwdriver-like tool that is specifically designed to traverse down the slit, or scored line 33, or it may be ejected with an ejector device if no tab is employed. In any event, the container is carefully removed from the test sample by either tearing along the scored line 33 or pulling the tab 41 and pulling strip 35 from the mold.

Thereafter, the test sample is allowed to cure for the desired interval period and capped with a capping compound before it is destructively tested. The capping compound is a unique composition that will cure in only two (2) hours to have a compressive strength greater than that of the test sample of concrete.

As indicated hereinbefore, the capping compound will ordinarily be put into a heating unit and raised to a temperature of 275° F. or higher to produce a molten slurry which is then trowled, or smeared, over the ends to form a cap that has high strength. With this compound it will form the strength of about 8,000 pounds per square inch in compression. The ASTM specification requires about 5,000 pounds per square inch compression. After the capping compound is allowed to cure the sample is then destructively tested.

As indicated hereinbefore, it is sometimes preferable to employ lubrication to create a hydrophobic surface of a mold to facilitate removal; but is not necessary with this invention because of the ability to remove the mold.

It should be borne in mind that any size sample may be employed to test a variety of characteristics of the material; for example, compression, tension, column action or the like.

Although this invention has been described with a certain degree of particularity, it is understood that the present disclosure is made only by way of example and that numerous changes in the details of construction and the combination and arrangement of parts may be resorted to without departing from the spirit and the scope of the invention, reference being had for the latter purpose to the appended claims.

What is claimed is:

1. A combination container and mold comprising:

a. a container bucket portion including a unitary plastic piece having a closed bottom end; a cylindrical, tubular wall extending substantially perpendicular to said bottom end and connected therewith and terminating in an open end; said cylindrical tubular wall being so nearly cylindrical that all diameters thereof are within Δd specifications allowed by the American Society for Testing Materials (ASTM) C-470; an annular lip being connected to said cylindrical tubular wall adjacent said open end to reinforce said open end and keep said open end within Δd inch of being circular so as to be within ASTM Specification C-470; and removing means for facilitating removal of said mold from the set test sample; said lip having an underside; said removing means being disposed longitudinally of said cylindrical, tubular wall and adapted to facilitate rending said wall for removal of said mold;

b. a locking, moisture-proof lid consisting essentially of a circular portion having a substantially flat top for extending across said open end of said bucket portion and having a downwardly depending skirt at its periphery for grippingly encompassing the outside periphery of said lip on said bucket; said skirt including a tapered shoulder means for being slid downwardly over said lip and snapping into conforming engagement with said underside of said lip; and c. a carrying tong having a handle at least as long as the diameter of said bucket portion, downwardly depending bail sections at each end of said handle and connected therewith, and a carrying means for picking up and carrying said container bucket portion and lid and any sample of material therewithin.

2. The combination container and mold of claim 1 wherein said removing means comprises at least one scored stripping line.

3. The combination container and mold of claim 2 wherein said removing means comprises a pair of scored stripping lines defining a tear away strip therebetween and traversing longitudinally of said cylindrical, tubular wall such that said tear away strip can be torn away readily, thereby facilitating removing said mold from said test sample.

4. The combination container and mold of claim 1 wherein said wall has on its outside an area of textured surface adapted for receiving a written legend.

5. The combination container and mold of claim 1 wherein said cylinder is six inches in diameter and said Δd is 1/16 inch.

6. The combination container and mold of claim 5 wherein the thickness of said wall is in the range of 0.05 inch–0.125 inch, and said annular lip has a lateral dimension in the range of 0.25–0.75 inch.

7. The combination container and mold of claim 6 wherein said thickness of said wall is about 0.070 inch, said lateral dimension of said lip is about 0.6 inch.

8. The combination container and mold of claim 1 wherein said Δd is 1/16 inch.

9. The combination container and mold of claim 1 wherein said lip also has a substantially planar annular portion intermediate said underside of said lip and said wall; and said carrying means includes arcuately, upwardly bent end having substantially planar flat end for engaging said annular portion when pulled upwardly thereagainst; and is adapted for contacting said annular portion without moving said lid out of snapping engagement with the underside of said lip.

10. The combination container and mold of claim 1 wherein said lid has an interiorly disposed annular ring substantially coextensive with said lip and extending downwardly from the inside of said top in a distance to the range of 0.02–0.05 inch.

11. The combination container and mold of claim 1 wherein said handle is longer than the diameter of said lid and has its said carrying means extending interiorly and upwardly to engage beneath said lip without distorting said lid when carried.

* * * * *